US010632645B2

(12) United States Patent
Lloyd

(10) Patent No.: US 10,632,645 B2
(45) Date of Patent: Apr. 28, 2020

(54) METHOD OF TREATING WOOD

(71) Applicant: Nisus Corporation, Rockford, TN (US)

(72) Inventor: Jeffrey D. Lloyd, Knoxville, TN (US)

(73) Assignee: Nisus Corporation, Rockford, TN (US)

( * ) Notice: Subject to any disclaimer, the term of this patent is extended or adjusted under 35 U.S.C. 154(b) by 51 days.

(21) Appl. No.: 14/079,928

(22) Filed: Nov. 14, 2013

(65) Prior Publication Data

US 2014/0109434 A1 Apr. 24, 2014

Related U.S. Application Data

(63) Continuation-in-part of application No. 13/852,099, filed on Mar. 28, 2013, now abandoned.

(60) Provisional application No. 61/648,118, filed on May 17, 2012, provisional application No. 61/617,170, filed on Mar. 29, 2012.

(51) Int. Cl.

| | |
|---|---|
| ***B27K 3/02*** | (2006.01) |
| ***B27K 5/00*** | (2006.01) |
| ***B27K 3/16*** | (2006.01) |
| ***B27K 1/00*** | (2006.01) |

(52) U.S. Cl.

CPC ..... *B27K 3/0207* (2013.01); *B27K 1/00* (2013.01); *B27K 3/0257* (2013.01); *B27K 3/0285* (2013.01); *B27K 3/163* (2013.01); *B27K 5/001* (2013.01)

(58) Field of Classification Search

CPC .... B27K 3/207; B27K 3/0257; B27K 3/0285; B27K 3/163; B27K 1/00; B27K 5/01

See application file for complete search history.

(56) References Cited

U.S. PATENT DOCUMENTS

| | | | | | |
|---|---|---|---|---|---|
| 3,007,844 | A | | 11/1961 | Schulz | |
| 3,560,251 | A | * | 2/1971 | Hager | B27K 3/0292 34/350 |
| 3,945,835 | A | | 3/1976 | Clarke et al. | |
| 3,995,077 | A | * | 11/1976 | Hager | B27K 3/0278 34/339 |
| 4,325,993 | A | | 4/1982 | Schroder | |
| 4,371,572 | A | * | 2/1983 | Hager | B27K 5/001 427/298 |
| 4,656,060 | A | | 4/1987 | Krzyzewski | |
| 4,759,872 | A | | 7/1988 | Marx et al. | |
| RE33,121 | E | | 11/1989 | Kirchner | |
| 5,024,861 | A | * | 6/1991 | Vinden et al. | 427/254 |
| 5,246,652 | A | | 9/1993 | Hsu et al. | |
| 5,330,847 | A | | 7/1994 | Murphy et al. | |
| 5,763,338 | A | | 6/1998 | Sean | |
| 5,783,258 | A | | 7/1998 | Garapick | |
| 6,235,403 | B1 | * | 5/2001 | Vinden | B27K 1/00 427/297 |
| 6,387,689 | B1 | | 5/2002 | Illman et al. | |
| 6,528,175 | B2 | | 3/2003 | Grantham et al. | |
| 6,667,350 | B1 | | 12/2003 | Satula | |
| 7,666,254 | B1 | * | 2/2010 | Romero Amaya et al. | 106/18.3 |
| 7,678,309 | B2 | * | 3/2010 | Jarck | 264/112 |
| 7,838,446 | B2 | | 11/2010 | Jarck | |
| 7,851,021 | B2 | | 12/2010 | Joyce et al. | |
| 7,935,182 | B2 | | 5/2011 | Humar et al. | |
| 2001/0037035 | A1 | * | 11/2001 | Kutcel | C01B 35/121 558/286 |
| 2002/0172723 | A1 | * | 11/2002 | Galyon et al. | 424/660 |
| 2003/0064113 | A1 | | 4/2003 | Bosserman | |
| 2003/0121445 | A1 | * | 7/2003 | Herbert et al. | 106/16 |
| 2005/0013939 | A1 | | 1/2005 | Vinden et al. | |
| 2005/0126430 | A1 | | 6/2005 | Lightner, Jr. et al. | |
| 2006/0071196 | A1 | * | 4/2006 | McKee et al. | 252/380 |
| 2007/0042161 | A1 | | 2/2007 | Gibbs | |
| 2007/0056655 | A1 | | 3/2007 | Vinden | |
| 2007/0227399 | A1 | | 10/2007 | Abou-Nemeh | |
| 2009/0110842 | A1 | | 4/2009 | Vinden et al. | |
| 2010/0003411 | A1 | | 1/2010 | Guthner et al. | |
| 2011/0250358 | A1 | | 10/2011 | Zhang et al. | |
| 2011/0300302 | A1 | | 12/2011 | Frazer | |

* cited by examiner

*Primary Examiner* — Dah-Wei D. Yuan
*Assistant Examiner* — Nga Leung V Law
(74) *Attorney, Agent, or Firm* — Luedeka Neely Group, P.C.

(57) ABSTRACT

A method of treating an elongate wood member is provided, the wood member having an outer surface and a cross-section. The method includes (1) forming a plurality of holes into the outer surface of the wood member; (2) introducing a treatment composition which includes a boron-containing compound into the plurality of holes; and (3) steam treating the wood member for a duration of from about 15 minutes to about 24 hours, the steam having a temperature of from about 80° C. to about 150° C. The steam treatment causes the boron-containing compound to diffuse from the formed holes into the cross-section of the wood member.

11 Claims, No Drawings

METHOD OF TREATING WOOD

CROSS-REFERENCE TO RELATED APPLICATIONS

This application is a continuation-in-part of U.S. application Ser. No. 13/852,099, filed Mar. 28, 2013, the entire disclosure of which is incorporated herein by reference. This application also claims priority to U.S. Provisional Application No. 61/617,170 filed Mar. 29, 2012, and U.S. Provisional Application No. 61/648,118 filed May 17, 2012, the entire disclosures of which are incorporated herein by reference.

FIELD

This invention relates to the field of wood treatment processes. More particularly, this invention relates to a method for treating wood using wood preservative and a boron-containing solution with steam introduction or generation.

BACKGROUND

Wood, particularly untreated wood (including lumber, timber and composites), is subject to damage caused by various environmental factors such as weather, heat, and living organisms, such as fungi or bacteria. Water and fungus may penetrate into the wood leading to decay, rot and a decrease in the strength, form and overall structure and quality of the wood.

Wood treatment methods, requiring various chemicals, have been offered in an effort to prevent or slow the damage caused to wood products by insects or water. One method used to treat wood involves the use of borate. Typically when treating wood products, it is important that the treatment be absorbed throughout the wood for effective protection of the wood. However, typical treatments of wood products with borates make it difficult to further treat the wood product with a preservative composition as treatment with a borate compound may substantially inhibit treatment with a preservative composition and vice versa.

What is needed, therefore, is a better, and more effective wood treatment process to ensure substantially complete penetration of a wood treatment composition and preservative into wood.

SUMMARY OF THE INVENTION

The aforementioned and other needs are fulfilled by one or more aspects of the invention disclosed herein. The present disclosure relates to a method of using a wood treatment composition on untreated wood with the method and using the composition disclosed herein.

In a first aspect, the present disclosure provides a method of treating wood comprising the steps of: (1) contacting an outer surface of the wood with a boron-containing compound; (2) introducing steam to the outer surface of the contacted wood for a duration of from about 15 minutes to about 240 minutes, the steam having a temperature of from about 100° C. to about 150° C.; and (3) applying a preservative composition optionally diluted in a carrier solvent to the surface of the steamed wood. The introduced steam enhances absorption of the boron-containing compound into the wood while substantially evaporating moisture within the wood, thereby allowing the preservative composition to be subsequently absorbed into the wood.

In certain embodiments, the wood is placed in a pressure chamber, either after having been treated with the boron containing solution or treated with the boron containing solution within the pressure chamber itself. The pressure chamber with water in the bottom is then heated with optionally reduced pressure conditions applied to the pressure chamber to generate steam with a temperature from about 50° C. to 100° C. Alternatively, live steam is introduced to the outer surface of the wood having a temperature of above 100° C. In some embodiments, the method of treating wood further includes the step of placing the wood in a pressure chamber and applying one or more cycles of reduced pressure and elevated pressure conditions to the pressure chamber after immersing the wood with the preservative composition to infuse the preservative composition into the wood.

In certain embodiments, the wood is selected from the group consisting of pine, oak, gum, spruce, cedar, fir and hemlock.

In some embodiments, the wood has a moisture content of less than 100% prior to contacting the outer surface of the wood with the boron-containing compound. In other embodiments, the boron-containing compound is selected from the group consisting of boric acid, sodium or potassium borates, sodium calcium borates, disodium octaborate tetrahydrate, pentaborate, hexaborate and combinations thereof.

In certain embodiments, the preservative composition is an oil-based preservative selected from the group consisting of diesel, fuel oil, biofuel, plant-derived oil, recycled engine oil, and mixtures thereof. In other embodiments, the preservative composition comprises an oil-borne preservative selected from the group consisting of copper naphthenate, pentachlorophenol, creosote and mixtures thereof.

In a second aspect, the present disclosure provides a method of treating wood comprising the steps of: (1) contacting an outer surface of the wood with an aqueous boron-containing solution heated to a temperature of from about 50° C. to about 150° C., the heated aqueous boron-containing solution including a solvent and a boron-containing compound; (2) exposing the contacted wood to one or more cycles of sub-atmospheric pressure; and (3) impregnating the wood with a preservative composition. The one or more cycles of reduced pressure reduces the boiling point of the aqueous boron-containing solution such that the solvent of the solution is substantially evaporated.

In certain embodiments, the heated boron-containing compound is selected from the group consisting of boric acid, borax, sodium or potassium borates, sodium calcium borates, disodium octaborate tetrahydrate, pentaborate, hexaborate and mixtures thereof.

In some embodiments, the heated aqueous boron-containing solution is at a temperature of from about 85° C. to about 95° C.

In other embodiments, the wood has a moisture content of less than 100% prior to contacting the outer surface of the wood with the heated boron-containing solution.

In certain embodiments, one or more cycles of reduced pressure conditions are applied to the wood after contacting the wood with the aqueous boron-containing solution for substantially evaporating the solvent of the boron-containing solution.

In other embodiments, from about 0.1% to about 100% of the preservative composition is diluted in a carrier solvent prior to impregnating the wood with the preservative composition.

In a third aspect, the present disclosure provides a method of treating wood comprising the steps of: (1) placing the wood in a pressure cylinder; (2) filling the pressure cylinder with a heated aqueous boron-containing solution; (3) removing the aqueous boron-containing solution from the pressure cylinder; (4) applying one or more cycles of reduced pressure conditions in the pressure cylinder to substantially evaporate the aqueous solution, with optionally the use of steam; (5) applying a preservative composition to the wood; and (6) applying one or more cycles of reduced pressure and elevated pressure conditions in the pressure cylinder to infuse the preservative composition and carrier solvent into the wood.

In still another aspect, the present disclosure provides a method of treating an elongate wood member, having an outer surface and a cross-section. In one embodiment, the method includes the steps of: (1) forming a plurality of holes into the outer surface of the wood member; (2) introducing a treatment composition which includes a boron-containing compound into the plurality of holes; and (3) steam treating the wood member for a duration of from about 15 minutes to about 24 hours, the steam having a temperature of from about 80° C. to about 150° C. The steam treatment causes the boron-containing compound to diffuse from the formed holes into the cross-section of the wood member.

In certain embodiments, the wood member is preferably made up of wood selected from the group consisting of pine, oak, hickory, gum, spruce, cedar, fir, eucalyptus, and hemlock.

In certain embodiments, the boron-containing compound is preferably selected from the group consisting of boric acid, sodium pentaborate, disodium octaborate tetrahydrate, borax, boron esters, and mixtures thereof. More preferably, the boron-containing compound preferably includes disodium octaborate tetrahydrate.

In certain embodiments, the boron-containing compound preferably makes up from about 10 to about 100 weight percent of the treatment composition. More preferably, the boron-containing compound preferably makes up from about 30 to about 50 weight percent of the treatment composition.

In certain embodiments, the treatment composition further includes at least one additive selected from the group consisting of glycols, anti-settling agents, preservatives, ethanolamines, and mixtures thereof. For instance, the treatment composition may include a preservative selected from the group consisting of copper naphthenate, pentachlorophenol, creosote and mixtures thereof.

In certain embodiments, the boron-containing compound preferably has a concentration gradient in which the boron-containing compound concentration is highest near a core of the wood member and lowest at the outer surface of the wood member.

In certain embodiments, the method also includes the further step of applying a preservative composition to the outer surface of the wood member. The preservative composition may include an oil selected from the group consisting of diesel, fuel oil, biofuel, plant-derived oil, recycled engine oil and mixtures thereof. In some instances, the preservative composition may include an oil-borne preservative selected from the group consisting of copper naphthenate, pentachlorophenol, creosote and mixtures thereof.

In some instances, the preservative composition preferably has a concentration gradient in which the preservative composition concentration is highest at the outer surface the wood member and lowest near a core of the wood member.

In yet another aspect, the present disclosure provides a method of treating an elongate wood member, having an outer surface and a cross-section. In one embodiment, the method includes the steps of: (1) forming a plurality of holes into the outer surface of the wood member; (2) introducing a treatment composition which includes a boron-containing compound into the plurality of holes; and (3) boultonizing the wood member with a heated oil solution for a duration of from about 15 minutes to about 24 hours, wherein the oil solution is heated to a temperature of from about 60° C. to about 200° C. and the boultonizing is carried out a subatmospheric pressure from about 15 to about 30 inches Hg of vacuum. The boultonizing treatment causes the boron-containing compound to diffuse from the formed holes into the cross-section of the wood member.

In certain embodiments, the wood member is preferably made up of wood selected from the group consisting of pine, oak, hickory, gum, spruce, cedar, fir, eucalyptus, and hemlock.

In certain embodiments, the boron-containing compound is preferably selected from the group consisting of boric acid, sodium pentaborate, disodium octaborate tetrahydrate, borax, boron esters, and mixtures thereof. More preferably, the boron-containing compound preferably includes disodium octaborate tetrahydrate.

In certain embodiments, the boron-containing compound preferably makes up from about 10 to about 100 weight percent of the treatment composition. More preferably, the boron-containing compound preferably makes up from about 30 to about 50 weight percent of the treatment composition.

In certain embodiments, the treatment composition further includes at least one additive selected from the group consisting of glycols, anti-settling agents, preservatives, ethanolamines, and mixtures thereof. For instance, the treatment composition may include a preservative selected from the group consisting of copper naphthenate, pentachlorophenol, creosote and mixtures thereof.

In certain embodiments, the boron-containing compound preferably has a concentration gradient in which the boron-containing compound concentration is highest near a core of the wood member and lowest at the outer surface of the wood member.

In certain embodiments, the method also includes the further step of applying a preservative composition to the outer surface of the wood member. The preservative composition may include an oil selected from the group consisting of diesel, fuel oil, biofuel, plant-derived oil, recycled engine oil and mixtures thereof. In some instances, the preservative composition may include an oil-borne preservative selected from the group consisting of copper naphthenate, pentachlorophenol, creosote and mixtures thereof.

In some instances, the preservative composition preferably has a concentration gradient in which the preservative composition concentration is highest at the outer surface the wood member and lowest near a core of the wood member.

A more complete appreciation of the present disclosure and its scope can be obtained from the following description of the invention.

DETAILED DESCRIPTION OF THE INVENTION

The present disclosure provides compositions and methods of use for treating, protecting and preserving wood products by protecting them from common causes of damage to wood that include water, insects and fungi. As disclosed herein, wood is understood to include timber, lumber, and various composites thereof.

In a first aspect, the present disclosure provides a method of treating wood that includes, as a first step, contacting an outer surface of the wood with a treatment composition. In one embodiment of the present disclosure, the wood is initially dry and has a moisture content of preferably less than 70%, and more preferably less than 50% prior to contacting the outer surface of the wood with the treatment composition.

The treatment composition preferably includes a boron-containing compound. The boron-containing compound is preferably selected from the group consisting of boric acid, sodium or potassium borates, sodium calcium borates, disodium octaborate tetrahydrate, pentaborate, hexaborate and mixtures thereof. In one preferable embodiment, the treatment composition is comprised of from about 5% to about 50% by weight of the boron-containing compound. The treatment composition may include an insecticide to protect against wood-boring insects and also a fungicide to protect against the growth of fungi.

In one embodiment, the treatment composition is applied to the outer surface of the wood by immersing or dipping the wood into the treatment composition. Alternatively, the treatment composition may be sprayed or otherwise applied to the surface of the wood such that the surface of the wood is substantially coated with the treatment composition. In yet another alternative, the wood may be placed in a treatment vessel and the treatment composition may be added to the treatment vessel to substantially submerge the wood in the treatment composition. The wood may be submerged in the treatment composition for a few seconds (e.g. 8 seconds) to up to as many as several hours (e.g. 10 hours) depending on the solution concentration, viscosity and/or temperature. These factors are adjusted to achieve between approximately 0.1 and 0.4 pounds per cubic foot disodium octaborate tetrahydrate or equivalent elemental Boron retention.

Typically fluid is stored in wood in two locations: the cell wall of the wood and the cell lumen. First, fluid is absorbed by the cell walls. When the cell walls have absorbed the maximum amount of water the wood has reached its fiber saturation point ("FSP"). At its FSP, the wood has a moisture content of about 30%. The moisture content, measured as the amount of moisture in the wood, is the weight of fluid in the wood divided by the weight of the wood and then multiplied by 100 to determine the percentage. For example, if the weight of the water equals the weight of the wood, the moisture content percentage is 100%. If the water weighs more than the weight of the wood, the moisture content percentage is greater than 100%.

When the wood has reached its FSP, any additional water is present in the cell lumen, which is a hollow cavity found within the cell between the cell walls. When water enters into the cell lumen, the moisture content is further increased and in some instances may allow wood to attain a moisture content of 100% or more.

In a second step, after applying the treatment composition, the wood is exposed to steam. As referred to herein, steam is water vapor or the gaseous phase of water formed from water at a temperature over its boiling point. Additional substances may be present in the steam, such as additional treatment compositions or preservatives, with the water heated to its appropriate boiling point to substantially form a vapor.

Preferably, the wood is exposed to steam at a temperature of from about 100° C. to about 150° C. for a period of about 15 minutes to about 240 minutes at atmospheric pressure. Alternatively, the wood may be placed in a chamber and exposed to steam in a sub atmospheric vacuum, allowing the wood to be treated by steam at a lower temperature. For example, steam at a temperature of from about 50° C. to about 100° C. may be applied to the wood under a vacuum environment, for example at −25 inches Hg.

By applying steam to the wood, the heated vapor causes surface borate to dissolve and penetrate the wood rapidly by diffusion into the wood, allowing substantially all of the treatment composition to be applied throughout the wood. Additionally, the steam heated above 100° C. at atmospheric pressure evaporates any excess moisture within the wood, removing the excess moisture from the pressure chamber under vacuum, thereby allowing the treatment composition to be absorbed into the wood without creating excess moisture in the wood.

It has been found that by applying the treatment composition and then soon thereafter applying steam to the wood, it is possible to further treat the wood with a preservative composition. Ordinarily if a treatment composition is applied to wood it sufficiently wets and blocks the surface of the wood and prevents application and penetration of the preservative composition.

The preservative composition is preferably an oil selected from the group consisting of diesel, fuel oil, biofuel, plant-derived oil (such as vegetable oil, pyrolosis produced oil or solvent extracted oil), recycled engine oil and mixtures thereof. In an alternative embodiment, the preservative composition comprises an oil-borne preservative selected from the group consisting of copper naphthenate, pentachlorophenol, creosote and mixtures thereof.

By treating wood in accordance with the present disclosure, the steam encourages absorption of the treatment composition into the interior of the wood and reduces the moisture content of the wood. Because the steam evaporates excess moisture, the preservative composition is then readily absorbed into the wood and not inhibited by the presence of the treatment composition solvent.

In accordance with the present disclosure, a pressure treatment process is described to infuse the preservative composition into the wood. The pressure treatment process enables the preservative composition to impregnate the cell wall and optionally fill or partially fill the cell lumen with the preservative composition, which provides for maximum impregnation and retention of the treatment composition into the wood. The pressure treatment process uses changes in pressure within a sealed pressure chamber to cause the preservative composition that has been applied to the wood to be infused into the wood.

Alternatively, a pressure treatment process is described which works best on dry wood having the least amount of moisture possible, with the moisture content of the wood preferably below 50%. The process is used to impregnate both the cell wall and optionally the lumen with the treatment composition, which provides for maximum impregnation and retention of the preservative composition into the wood. This method relies on the change of pressure in the inner structure of the wood to cause the applied preservative composition to be forced into the wood. More particularly, the pressure treatment is accomplished by placing the wood into a pressure chamber and subjecting it to a cycle of changing pressure conditions that are used to (1) optionally remove, leave or add air, (2) to introduce and urge the preservative composition into the interior structure of the wood and (3) to remove excess preservative composition after impregnation by the preservative composition.

In another aspect, the present disclosure provides a method of treating wood that includes, as a first step, placing the wood in a pressure cylinder. The pressure cylinder is substantially filled with a treatment composition such that the outer surface of the wood is substantially coated with or submerged in the treatment composition. Filling may optionally be done under vacuum and/or with applied pressure depending on the solution concentration and viscosity and time of immersion. The treatment composition is preferably a boron-containing compound such as boric acid, sodium or potassium borates, sodium calcium borates, disodium octaborate tetrahydrate, pentaborate, hexaborate and mixtures thereof.

Next, the treatment composition is substantially removed from the pressure cylinder. Soon after removing the treatment composition, steam is introduced into the pressure cylinder to contact the wood. In one embodiment, the steam is introduced to the pressure cylinder at atmospheric pressure, the steam preferably having a temperature of between about 100° C. to about 150° C. Alternatively, a vacuum may be applied to the pressure cylinder, allowing steam at a lower temperature to be generated or introduced to the pressure cylinder for contacting the wood, the steam under vacuum preferably having a temperature of from about 50° C. to about 100° C. The steam is introduced into the pressure cylinder preferably for a duration of from about 15 minutes to about 480 minutes.

After the wood has been exposed to the steam introduced into the pressure cylinder and subsequently cleared of steam under vacuum, a preservative composition is introduced into the pressure cylinder such that the wood is contacted with the preservative composition. After the wood has been immersed in the preservative composition, one or more cycles of increased and reduced pressure are applied to the pressure cylinder to further infuse the preservative composition into the wood. The pressure cylinder may then be returned to atmospheric pressure for safe removal of the dual treated wood.

In yet another aspect, the present disclosure provides a method of treating wood that includes, as a first step, contacting an outer surface of the wood with a heated aqueous boron-containing solution. The aqueous boron-containing solution is preferably formed of a solvent and a boron-containing compound. The solvent is preferably water. The boron-containing compound is preferably selected from the group consisting of boric acid, borax, sodium or potassium borates, sodium calcium borates, disodium octaborate tetrahydrate, pentaborate, hexaborate and mixtures thereof. In one embodiment, the aqueous boron-containing solution is comprised of from about 5% to about 50% by weight of the boron-containing compound.

In one embodiment, the aqueous boron-containing solution is preferably heated from about 50° C. to about 150° C. More preferably, the aqueous boron-containing solution is heated from about 85° C. to about 95° C. In one embodiment, a higher pressure may be applied to the solution such that the aqueous boron-containing solution obtains better initial penetration. The heated aqueous boron-containing solution is applied to the outer surface of the wood by immersing or dipping the wood into the heated aqueous boron-containing solution such that the boron-containing solution is absorbed into the wood.

After applying the heated aqueous boron-containing solution, it is removed and a lower pressure or vacuum is applied to the wood. The lower pressure or vacuum is such that the reduced pressure causes the solvent portion of the boron-containing solution to be substantially evaporated. By applying reduced pressure to the wood having absorbed the boron-containing solution, the boiling temperature of the boron-containing solution is reduced such that when the reduced boiling temperature caused by the lower pressure reaches the boiling temperature of the solvent of the heated boron-containing solution, the solvent is substantially evaporated. After the solvent evaporates, the boron-containing compound of the absorbed boron-containing solution remains in the wood.

In still another aspect, the present disclosure provides a method of treating an elongate wood member, having an outer surface and a cross-section. In one embodiment, the method includes the steps of: (1) forming a plurality of holes into the outer surface of the wood member; (2) introducing a treatment composition which includes a boron-containing compound into the plurality of holes; and (3) steam treating the wood member for a duration of from about 15 minutes to about 24 hours, the steam having a temperature of from about 80° C. to about 150° C. The steam treatment causes the boron-containing compound to diffuse from the formed holes into the cross-section of the wood member.

The wood member to be treated may be, for instance, a railroad tie, a utility pole, a bridge tie, or other large timbers. Smaller lumber, such as for residential decking, may also be treated according to the method. Preferred woods for treatment according to this method may be selected from the group consisting of pine, oak, hickory, gum, spruce, cedar, fir, eucalyptus, and hemlock.

A plurality of holes are formed in the outer surface of the wood member, such as by drilling, pressing, saw cutting, or laser cutting. Typically each of the holes will have a diameter of about ¼ to about 2 inches and is formed to a depth of about ½ to about 8 inches, preferably about 2 inches. The holes are typically spaced apart a distance of about 2 to about 48 inches between each hole. The size and location of the holes may be adjusted in accordance with the size of the wood member being treated.

A treatment composition which includes at least one boron-containing compound is then introduced into the plurality of holes. Preferred boron-containing compound for this purpose may be selected from the group consisting of boric acid, sodium pentaborate, disodium octaborate tetrahydrate, borax, boron esters, and mixtures thereof. More preferably, the boron-containing compound preferably includes disodium octaborate tetrahydrate.

In general, the amount of the boron-containing compound in the treatment composition may range from about 10 to about 100 weight percent of the boron-containing compound. More preferably, the boron-containing compound preferably makes up from about 30 to about 50 weight percent of the treatment composition.

Optionally, the treatment composition may also include one or more further additives. Such additives may for instance be selected from the group consisting of glycols, anti-settling agents, preservatives, ethanolamines, and mixtures thereof. Suitable preservatives may for example be selected from the group consisting of copper naphthenate, pentachlorophenol, creosote and mixtures thereof.

The overall amount of treatment composition introduced into the holes is typically from about 0.1 to about 0.3 pounds of disodium octaborate tetrahydrate (DOT) per cubic foot (pcf) of the wood being treated, or an equivalent amount of another boron-containing compound. Thus, for a 50% by weight mixture of DOT, the amount of treatment composition introduced into the holes is typically from about 0.2 to about 0.6 pounds of the DOT mixture per cubic foot of the wood being treated.

In some instances, plastic collars or caps may be inserted into the upper portion of the holes in order to prevent spillage of the treatment composition. The use of such plastic collars or caps may also limit diffusion the treatment composition into the wood near the outer surface of the wood member. Instead the treatment composition is preferentially absorbed by the core or heartwood of the wood member.

Once the treatment composition is introduced, the wood member is then steam treated in pressure vessel. This steam treatment may last for a duration of from about 15 minutes to about 24 hours. The steam used in this treatment is generally at a temperature of from about 80° C. to about 150° C. It will be appreciated that to apply steam at a temperature below 100° C., the steam treatment is carried out at a subatmospheric pressure.

It has been found that this steam treatment causes the boron-containing compound to diffuse from the formed holes into the cross-section of the wood member. Advantageously, the diffused boron-containing compound imparts improved rot resistance to the wood member, as well as improved resistance to insect infestation, particularly termite infestation.

In particular, the steam treatment causes at least a portion the boron-containing compound, and preferably the majority of the boron-containing compound, to diffuse into the core or heartwood of the wood member. This is especially advantageous because it is difficult to treat this heartwood in the center of the wood member with preservatives using conventional treatment techniques. Such treatment techniques typically result in a preservative concentration gradient over a cross-section of the wood in which the concentration of preservative is highest at the outer surface of the wood and lowest (often zero) near the core of the wood member. The steam treatment method of the present invention, however, may provide a reversed concentration gradient, in which the concentration of the boron-containing compound is highest near the core of the wood member and lowest at the outer surface of the wood.

Moreover, because of this reversed concentration gradient, it has been found that the rate of leaching of the boron-containing compound from the wood member in the field—due to rain and other environmental factors—is substantially reduced.

In certain embodiments, the method also includes the further step of applying a preservative composition to the outer surface of the wood member. Coating the outer surfaces of the wood member with this preservative composition provides even further rot and insect resistance to the wood, beyond that already provided by the diffused boron-containing compound.

The preservative composition may, for instance, include an oil selected from the group consisting of diesel, fuel oil, biofuel, plant-derived oil, recycled engine oil and mixtures thereof.

In some instances, the preservative composition may include an oil-borne preservative selected from the group consisting of copper naphthenate, pentachlorophenol, creosote and mixtures thereof. When using copper naphthenate or pentachlorophenol, such oil-borne preservatives typically make up from about 0.5% to about 30% by weight of the preservative composition. In the case of creosote, however, the preservative may make up to 100% of the preservative composition.

When used, the overall amount of the actual preservative in the preservative composition applied to the outer surface of the wood member is typically from about 0.5 to about 5 pounds of preservative per cubic foot (pcf) of the wood being treated. In some instances, however, the amount of the preservative applied to the outer surface of the wood member may be up to about 10 pounds of preservative per cubic foot of the wood being treated.

Unlike the boron-containing compound, the concentration gradient over a cross-section of the wood of this preservative is typically highest at the outer surface of the wood and lowest near the core of the wood member.

In yet another aspect, the present disclosure provides a method of treating an elongate wood member, having an outer surface and a cross-section. In one embodiment, the method includes the steps of: (1) forming a plurality of holes into the outer surface of the wood member; (2) introducing a treatment composition which includes a boron-containing compound into the plurality of holes; and (3) boultonizing the wood member with a heated oil solution for a duration of from about 15 minutes to about 24 hours, wherein the oil solution is heated to a temperature of from about 60° C. to about 200° C. and the boultonizing is carried out a subatmospheric pressure from about 15 to about 30 inches Hg of vacuum. The boultonizing treatment causes the boron-containing compound to diffuse from the formed holes into the cross-section of the wood member.

The wood member to be treated may be, for instance, a railroad tie, a utility pole, a bridge tie, or other large timbers. Smaller lumber, such as for residential decking, may also be treated according to the method. Preferred woods for treatment according to this method may be selected from the group consisting of pine, oak, hickory, gum, spruce, cedar, fir, eucalyptus, and hemlock.

A plurality of holes are formed in the outer surface of the wood member, such as by drilling, pressing, saw cutting, or laser cutting. Typically each of the holes will have a diameter of about ¼ to about 2 inches and is formed to a depth of about ½ to about 8 inches, preferably about 2 inches. The holes are typically spaced apart a distance of about 2 to about 48 inches between each hole. The size and location of the holes may be adjusted in accordance with the size of the wood member being treated.

A treatment composition which includes at least one boron-containing compound is then introduced into the plurality of holes. Preferred boron-containing compound for this purpose may be selected from the group consisting of boric acid, sodium pentaborate, disodium octaborate tetrahydrate, borax, boron esters, and mixtures thereof. More preferably, the boron-containing compound preferably includes disodium octaborate tetrahydrate.

In general, the amount of the boron-containing compound in the treatment composition may range from about 10 to about 100 weight percent of the boron-containing compound. More preferably, the boron-containing compound preferably makes up from about 30 to about 50 weight percent of the treatment composition.

Optionally, the treatment composition may also include one or more further additives. Such additives may for instance be selected from the group consisting of glycerol, glycols, anti-settling agents, thickening agents, preservatives, ethanolamines, and mixtures thereof. Suitable preservatives may for example be selected from the group consisting of copper naphthenate, pentachlorophenol, creosote and mixtures thereof.

The overall amount of treatment composition introduced into the holes is typically from about 0.1 to about 0.3 pounds of disodium octaborate tetrahydrate (DOT) per cubic foot (pcf) of the wood being treated, or an equivalent amount of another boron-containing compound. Thus, for a 50% by weight mixture of DOT, the amount of treatment composition introduced into the holes is typically from about 0.2 to about 0.6 pounds of the DOT mixture per cubic foot of the wood being treated.

In some instances, plastic collars or caps may be inserted into the upper portion of the holes in order to prevent spillage of the treatment composition. The use of such plastic collars or caps may also limit diffusion the treatment composition into the wood near the outer surface of the wood member. Instead the treatment composition is preferentially absorbed by the core or heartwood of the wood member.

Once the treatment composition is introduced, the wood member is then subjected to a boultonizing treatment in pressure vessel. In this process, the wood member is placed in a heated oil solution while under a subatmospheric pressure. The combination of heat and vacuum thereby causes moisture within the wood to evaporate, drying the wood.

This boultonizing treatment may last for a duration of from about 15 minutes to about 24 hours. The oil solution used for boultonizing is generally heated to a temperature of from about 60° C. to about 200° C. and the boultonizing is carried out a subatmospheric pressure from about 15 to about 30 inches Hg of vacuum.

As with the aforementioned steam treatment, it has been found that this boultonizing treatment also causes the boron-containing compound to diffuse from the formed holes into the cross-section of the wood member. Advantageously, the diffused boron-containing compound imparts improved rot resistance to the wood member, as well as improved resistance to insect infestation, particularly termite infestation.

In particular, the boultonizing treatment causes at least a portion the boron-containing compound, and preferably the majority of the boron-containing compound, to diffuse into the core or heartwood of the wood member. This is especially advantageous because it is difficult to treat this heartwood in the center of the wood member with preservatives using conventional treatment techniques. Such treatment techniques typically result in a preservative concentration gradient over a cross-section of the wood in which the concentration of preservative is highest at the outer surface of the wood and lowest (often zero) near the core of the wood member. The boultonizing treatment method of the present invention, however, may provide a reversed concentration gradient, in which the concentration of the boron-containing compound is highest near the core of the wood member and lowest at the outer surface of the wood.

Moreover, because of this reversed concentration gradient, it has been found that the rate of leaching of the boron-containing compound from the wood member in the field—due to rain and other environmental factors—is substantially reduced.

In certain embodiments, the method also includes the further step of applying a preservative composition to the outer surface of the wood member. Coating the outer surfaces of the wood member with this preservative composition provides even further rot and insect resistance to the wood, beyond that already provided by the diffused boron-containing compound.

The preservative composition may, for instance, include an oil selected from the group consisting of diesel, fuel oil, biofuel, plant-derived oil, recycled engine oil and mixtures thereof.

In some instances, the preservative composition may include an oil-borne preservative selected from the group consisting of copper naphthenate, pentachlorophenol, creosote and mixtures thereof. When using copper naphthenate or pentachlorophenol, such oil-borne preservatives typically make up from about 0.5% to about 30% by weight of the preservative composition. In the case of creosote, however, the preservative may make up to 100% of the preservative composition.

When used, the overall amount of the actual preservative in the preservative composition applied to the outer surface of the wood member is typically from about 0.5 to about 5 pounds of preservative per cubic foot (pcf) of the wood being treated. In some instances, however, the amount of the preservative applied to the outer surface of the wood member may be up to about 10 pounds of preservative per cubic foot of the wood being treated.

Unlike the boron-containing compound, the concentration gradient over a cross-section of the wood of this preservative is typically highest at the outer surface of the wood and lowest near the core of the wood member.

The following non-limiting examples illustrate various additional aspects of the disclosure. Unless otherwise indicated, percentages are by weight based on the overall weight of the composition.

EXAMPLE 1

In this example, various species of wood were treated in accordance with the present disclosure. Specifically, two sets of each of dry Southern Yellow Pine having 8.1% moisture content were treated with the method disclosed above. Additionally, two sets of green hardwoods including white oak having 38% moisture content, red oak having 61.6% moisture content, and black gum having 98.6% moisture content were also treated.

First, each of the above samples was immersed in a liquid borate compound having 30% disodium octaborate tetrahydrate at ambient temperature. Next, one set of each sample was steam treated at a temperature of 110° C. under a pressure of 5 psi. The Southern Yellow Pine was treated under 110° C. and at a pressure of 5 psi for one hour while the green hardwoods were treated for two hours.

After these first two steps were completed, it was found that substantially no borate was found on the surface of the wood specimens nor was any borate compound found under or around the test specimens, indicating the borate compound had been absorbed into the wood specimens. Weight measurements of the wood specimens indicated that there was no substantial change in the moisture content of the wood specimens.

One set of each of the wood specimens was split and the specimens sprayed with curcumin to determine borate presence and penetration. It was found that at this stage, the steam treatment significantly improved borate penetration of the wood specimens.

In a final step, the treated steamed and un-steamed Southern Yellow Pine specimens were immersed in a preservative compound consisting of 0.8% (as elemental copper), copper naphthenate in #2 Diesel and placed in a vacuum chamber for 30 minutes followed by 10 minutes at atmospheric pressure. The wood specimens were then removed from the chamber and air-dried for 30 minutes and split to examine the penetration of the preservative compound. In the Southern Yellow Pine specimens that were not steam treated there was poor penetration of the preservative compound. However, in the specimens treated with the borate compound that were steam treated, it was found that the preservative compound completely penetrated the wood specimens.

EXAMPLE 2

In this example, wooden bridge ties were treated in accordance with the present disclosure. Specifically, a group of bridge ties including gum, white oak and hickory, each having a cross section of approximately 10 inches by 10 inches and a length of about 10 feet were treated. Prior to treatment, the bridge ties were "green", i.e., having a high moisture content.

First, a series of holes were drilled into each of the bridge ties. Each hole was approximately 2 inches in diameter, with a depth of about 6 inches. The holes were spaced apart about 24 inches. The holes were filled with an aqueous mixture of disodium octaborate tetrahydrate (DOT), comprising about 45 percent DOT by weight. A plastic cap was then inserted into the upper portion of each hole.

The bridge ties were then boultonized by treating them in a heated oil-based solution at a reduced pressure, and temperature of about 185° F. (85° C.) for about 18 hours. The oil-based boultonizing solution also included copper naphthenate in an amount of about 0.8 percent as copper. During the boultonizing process, the moisture content of the bridge ties was substantially reduced as the moisture in the wood evaporated.

After the boultonizing treatment, the plastic caps were removed so that the holes could be observed. It was found that substantially all of the DOT mixture was gone from the holes, having been absorbed by the wood. The bridge ties were then split open and sprayed with curcumin to determine borate presence and penetration. It was found that the DOT had not only thoroughly penetrated the heart wood, but the concentration of the DOT was highest near the core of the wood member and lowest at the outer radial and tangential surfaces of the wood.

The previously described embodiments of the present disclosure have many advantages. The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention.

What is claimed is:

1. A method of treating an elongate wood member, the wood member having an outer surface and a cross-section, the method comprising the steps of:

forming one or more holes into the outer surface of the wood member;

introducing an aqueous treatment composition comprising at least 30 weight percent of a boron-containing compound into the plurality of holes; and treating the wood member for a duration of from about 15 minutes to about 24 hours by Boultonizing the wood member in a heated oil solution while under a subatmospheric pressure, thereby causing moisture within the wood member to evaporate to steam, wherein the hot oil treatment causes the boron-containing compound to move from the formed holes into the cross-section of the wood member during the Boultonizing and wherein the boron-containing compound has a concentration gradient in the treated wood member in which the boron-containing compound concentration is highest near a core of the wood member and lowest at the outer surface of the wood member.

2. The method of claim 1, wherein the wood member comprises wood selected from the group consisting of pine, oak, hickory, gum, spruce, cedar, fir, eucalyptus, and hemlock.

3. The method of claim 1, wherein the boron-containing compound is selected from the group consisting of boric acid, sodium pentaborate, disodium octaborate tetrahydrate, borax, boron esters, and mixtures thereof.

4. The method of claim 1, wherein the boron-containing compound comprises disodium octaborate tetrahydrate.

5. The method of claim 1, wherein the treatment composition comprises from about 30 to about 50 weight percent of the boron-containing compound.

6. The method of claim 1, wherein the treatment composition further comprises at least one additive selected from the group consisting of glycols, preservatives, ethanolamines, and mixtures thereof.

7. The method of claim 6, wherein the treatment composition comprises a preservative selected from the group consisting of copper naphthenate, pentachlorophenol, creosote and mixtures thereof.

8. The method of claim 1, further comprising the step of applying a preservative composition to the outer surface of the wood member.

9. The method of claim 8, wherein the preservative composition comprises an oil selected from the group consisting of diesel, fuel oil, biofuel, plant-derived oil, recycled engine oil and mixtures thereof.

10. The method of claim 8, wherein the preservative composition comprises an oil-borne preservative selected from the group consisting of copper naphthenate, pentachlorophenol, creosote and mixtures thereof.

11. The method of claim 8, wherein the preservative composition has a concentration gradient in which the preservative composition concentration is highest at the outer surface the wood member and lowest near a core of the wood member.

* * * * *